US006992639B1

(12) United States Patent
Lier

(10) Patent No.: US 6,992,639 B1
(45) Date of Patent: Jan. 31, 2006

(54) HYBRID-MODE HORN ANTENNA WITH SELECTIVE GAIN

(75) Inventor: Erik Lier, Newton, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 15 days.

(21) Appl. No.: 10/742,464

(22) Filed: Dec. 18, 2003

Related U.S. Application Data

(60) Provisional application No. 60/440,715, filed on Jan. 16, 2003, provisional application No. 60/480,369, filed on Jun. 19, 2003.

(51) Int. Cl.
*H01Q 13/02* (2006.01)

(52) U.S. Cl. ..... 343/786

(58) Field of Classification Search ..... 343/785, 343/786, 787, 911 R, 872; 333/21 R, 240, 333/248, 251

See application file for complete search history.

(56) References Cited

U.S. PATENT DOCUMENTS

| | | | | |
|---|---|---|---|---|
| 2,650,985 | A * | 9/1953 | Meyer et al. | 343/786 |
| 4,246,584 | A * | 1/1981 | Noerpel | 343/786 |
| 5,117,240 | A * | 5/1992 | Anderson et al. | 343/786 |
| 5,166,698 | A * | 11/1992 | Ashbaugh et al. | 343/783 |
| 5,642,122 | A * | 6/1997 | Lockie et al. | 343/881 |
| 6,266,025 | B1 * | 7/2001 | Popa et al. | 343/785 |
| 6,323,818 | B1 * | 11/2001 | Koh et al. | 343/786 |
| 6,456,254 | B1 * | 9/2002 | Reineix et al. | 343/840 |
| 6,501,433 | B2 * | 12/2002 | Popa et al. | 343/785 |

OTHER PUBLICATIONS

P.J.B. Clarricoats and A.D. Olver, "Propagation and Radiation Characteristics of Cylindrical Corrugated Waveguides", Corrugated Horns for Microwave Antennas, Chapter 3, 1984, pp. 20-57, Peter Peregrinus Ltd., London, UK.

R. J. Dewey, "Circularly Polarized Elliptical Beamshape Horn Antennas", Int. J. Electronics, 1982, pp. 101-103, vol. 53, No. 2.

Eric Lier, "Hybrid-Mode Horn Antenna with Design-Specific Aperture Distribution and Gain", presented IEEE Antennas and Propagation Society International Symposium, Jun. 22-27, 2003, Columbus, Ohio (6 pages).

T. Pratt and Charles W. Bostian, "Satellite Communications: Satellite Antennas", 1986, pp. 78-90, John Wile & Sons, New York.

Peter A. Rizzi, "Microwave Engineering: Passive Circuits", 1988, pp. 306-311, Prentice-Hall Englewood Cliffs, New Jersey.

(Continued)

*Primary Examiner*—Shih-Chao Chen
*Assistant Examiner*—Minh Dieu A
(74) *Attorney, Agent, or Firm*—McDermott Will & Emery LLP

(57) ABSTRACT

The present invention provides a new class of hybrid-mode horn antennas. The present invention facilitates the design of boundary conditions between soft and hard, supporting modes under balanced hybrid condition with uniform as well as tapered aperture distribution. In one embodiment, the horn antenna (100) is relatively simple mechanically, has a reasonably large bandwidth, supports linear as well as circular polarization, and is designed for a wide range of aperture sizes.

24 Claims, 11 Drawing Sheets

OTHER PUBLICATIONS

"Soft And Hard Horn Antennas", by Erik Lier, et al., IEEE Transactions On Antennas And Propagation, vol. 36, No. 8, Aug. 1988.

E. Lier, "A Dielectric Hybrid Mode Antenna Feed: A Simple Alternative to the Corrugated Horn", IEEE Transactions on Antennas and Propagation, Jan. 1, 1986, pp. 21-29, vol. AP-34, No. 1.

E. Lier and Per-Simon Kildal, "Dielectrically Lined Horn Antennas", Workshop on Primary Feeds and RF-Sensing Systems. ESTEC. The Netherlands, Jun. 10-11, 1987.

"Military Space Programs: GPS Blocker II R", FAS Space Policy Project (visited Jan. 13, 2003) <http://www.fas.org/spp/military/program/nav/gps_2r.htm> (3 pages).

* cited by examiner a. b.

HYBRID-MODE HORN ANTENNA WITH SELECTIVE GAIN

RELATED APPLICATIONS

The present application claims priority from U.S. Provisional Application No. 60/440,715, filed Jan. 16, 2003, entitled "Dielectric-Loaded Hybrid-Mode Horn Antenna with Selectable or High Gain and Large Bandwidth"; and from U.S. Provisional Application No. 60/480,369, filed Jun. 19, 2003, entitled "Hybrid-Mode Horn Antenna with Selective Gain", the complete disclosures of which are incorporated herein by reference for all purposes.

BACKGROUND OF THE INVENTION

The present invention is directed generally to horn antennas, and more specifically to a new class of hybrid-mode horn antennas having selective gain.

Maximum directivity from a horn antenna is obtained by uniform amplitude and phase distribution over the horn aperture. Such horns are denoted as "hard" horns. They can support the transverse electromagnetic (TEM) mode, and apply to linear as well as circular polarization. They are characterized with hard boundary impedances:

$$Z_z=-E_z/H_x=0 \text{ and } Z_x=E_x/H_z=\infty, \quad (1)$$

or soft boundary impedances:

$$Z_z=E_z/H_x=\infty \text{ and } Z_x=E_x/H_Z=0, \quad (2)$$

meeting the balanced hybrid condition:

$$Z_zZ_x=\eta_0^2, \quad (3)$$

where $\eta_0$ is the free space wave impedance and the coordinates z and x are defined as longitudinal with and transverse to the direction of the wave, respectively.

Hard horns can be used in the cluster feed for multibeam reflector antennas to reduce spillover loss across the reflector edge. Such horns may also be useful in single feed reflector antennas with size limitation, and in quasi-optical amplifier arrays.

Two different hard horns which meet these conditions are one having longitudinal conducting strips on a dielectric wall lining, and the other having longitudinal corrugations filled with dielectric material. These horns work for various aperture sizes, and have increasing aperture efficiency for increasing size as the power in the wall area relative to the total power decreases. Dual mode and multimode horns like the Box horn can also provide high aperture efficiency, but they have a relatively narrow bandwidth, in particular for circular polarization. Higher than 100% aperture efficiency relative to the physical aperture may be achieved for endfire horns. However, these endfire horns also have a small intrinsic bandwidth and may be less mechanically robust. Linearly polarized horn antennas may exist with high aperture efficiency at the design frequency, large bandwidth and low cross-polarization. However, these as well as the other non hybrid-mode horns only work for limited aperture size, typically under 1.5 to 2λ.

BRIEF SUMMARY OF THE INVENTION

The present invention provides a new class of hybrid-mode horn antennas. The present invention facilitates the design of boundary conditions between soft and hard, supporting modes under balanced hybrid condition with uniform as well as tapered aperture distribution. In one embodiment, the horn is relatively simple mechanically, has a reasonably large bandwidth, can support linear as well as circular polarization, and can be designed for a wide range of aperture sizes.

In one embodiment, antennas of the present invention are dielectric-loaded circularly or linearly polarized hybrid-mode horn antennas which can be designed to a desired high directivity (gain) and low cross-polarization (axial ratio) over a wide frequency band. In one embodiment of the present invention, an antenna comprises a dielectric core inside a horn, where the core has two or more dielectric layers, and where the core is separated from the horn wall. The antenna boundary conditions facilitate a balanced hybrid-mode in the inner dielectric region with zero or negligible cross-polarization at the design frequency. With proper design, this mode can be close to a TEM mode with uniform or nearly uniform aperture distribution and consequently high gain.

Horn antennas of the present invention will have a wide range of uses. For example, in one embodiment the horn is used as an element in a limited scan phased array where a larger element aperture size is needed. They may provide high aperture efficiency and low grating lobes. In another embodiment, the horns are used as feed elements for reflector antennas or in quasi-optical amplifier arrays. It could be particularly useful in millimeter wave applications. Embodiments having a flat top pattern design make it a candidate earth coverage horn on-board satellites and a candidate feed for reflector antennas with enhanced directivity.

In one embodiment, a horn antenna of the present invention includes a conducting horn, a first dielectric layer disposed over at least a portion of the conducting horn, a second dielectric layer disposed over at least a portion of the first dielectric layer, and a third dielectric layer disposed over at least a portion of the second dielectric layer.

In alternative embodiments, the second dielectric layer comprises a higher dielectric constant than the third dielectric layer, and the third dielectric layer comprises a higher dielectric constant than the first dielectric layer. The first dielectric layer further may comprise a gas or air-filled gap, a vacuum region, and the like.

In one aspect, the conducting horn comprises an inner wall surface, and the second dielectric layer is spaced apart from the inner wall surface by a plurality of spacers. At least one of the spacers may be aligned axially or circumferentially relative to the conducting horn.

In one aspect, the first and second dielectric layers have a generally uniform thickness in an axial direction of the conducting horn. In another aspect, the first and/or second dielectric layer have a variable thickness in the axial direction. The horn antenna may further include a matched horn throat defined by at least a portion of the second and third dielectric layers. The horn antenna also may include an impedance matching layer near the aperture. The matching layer may be a portion of the second and/or third dielectric layers. In one aspect, the impedance matching layer is a corrugated matching layer. In another aspect, the matching layer comprises a plurality of spaced apart holes, rings, ringlets, or the like.

In another embodiment of the present invention, a horn antenna includes a dielectric core coupled to a conducting horn by a plurality of spacers to define a gap between the horn and core. The dielectric core includes an outer portion and an inner portion, with the outer and inner portions each including a dielectric material. The inner portion dielectric material has a different dielectric constant than the outer portion dielectric material. In one aspect, the dielectric constant of the outer portion dielectric material is greater than the dielectric constant of the inner portion dielectric material. In another aspect, the gap is at least partially filled, or completely filled with a third dielectric material having a lower dielectric constant than the dielectric constants of both the inner and outer portion dielectric materials.

Another embodiment of the present invention includes a reflector antenna having a reflective dish and at least one horn antenna as previously described. The horn antenna is adapted to direct a signal towards the reflective dish. In another embodiment, the present invention provides an antenna array system comprising two or more horn antennas. In still another embodiment, the present invention provides a spacecraft incorporating horn antenna(s) as described herein. The horn antenna(s) may be coupled to a spacecraft bus as needed for antenna operation.

The summary provides only a general outline of some embodiments according to the present invention. Many other objects, features and advantages of the present invention will become more fully apparent from the following detailed description, the appended claims and the accompanying drawings.

DETAILED DESCRIPTION OF THE INVENTION

In one embodiment, a new and mechanically simple dielectric loaded hybrid-mode horn is presented. In alternative embodiments of the present invention, the horn satisfies hard boundary conditions, soft boundary conditions, or boundaries between hard and soft under balanced hybrid conditions (low cross-polarization). Like other hybrid mode horns, the present design is not limited in aperture size. In some embodiments, design curves were developed based on a plane wave model, and radiation performance was computed based on a cylindrical waveguide model. In one embodiment, aperture efficiency of about ninety-four percent (94%) has been computed at the design frequency for a 3.38λ aperture with hard boundary condition and a dielectric constant of 4.0. The same horn with a dielectric constant of 2.5 can provide higher than about eighty-nine percent (89%) aperture efficiency and under −30 decibels (dB) cross-polarization over about a fifteen percent (15%) frequency range. Predicted peak sidelobes ranging from −19 to −26.5 dB at the design frequency have been obtained. In one embodiment, the horn can be designed to radiate a flat-top pattern. In a particular embodiment, the horn could be useful for millimeter wave applications and quasi-optical amplifiers.

Figure 1:
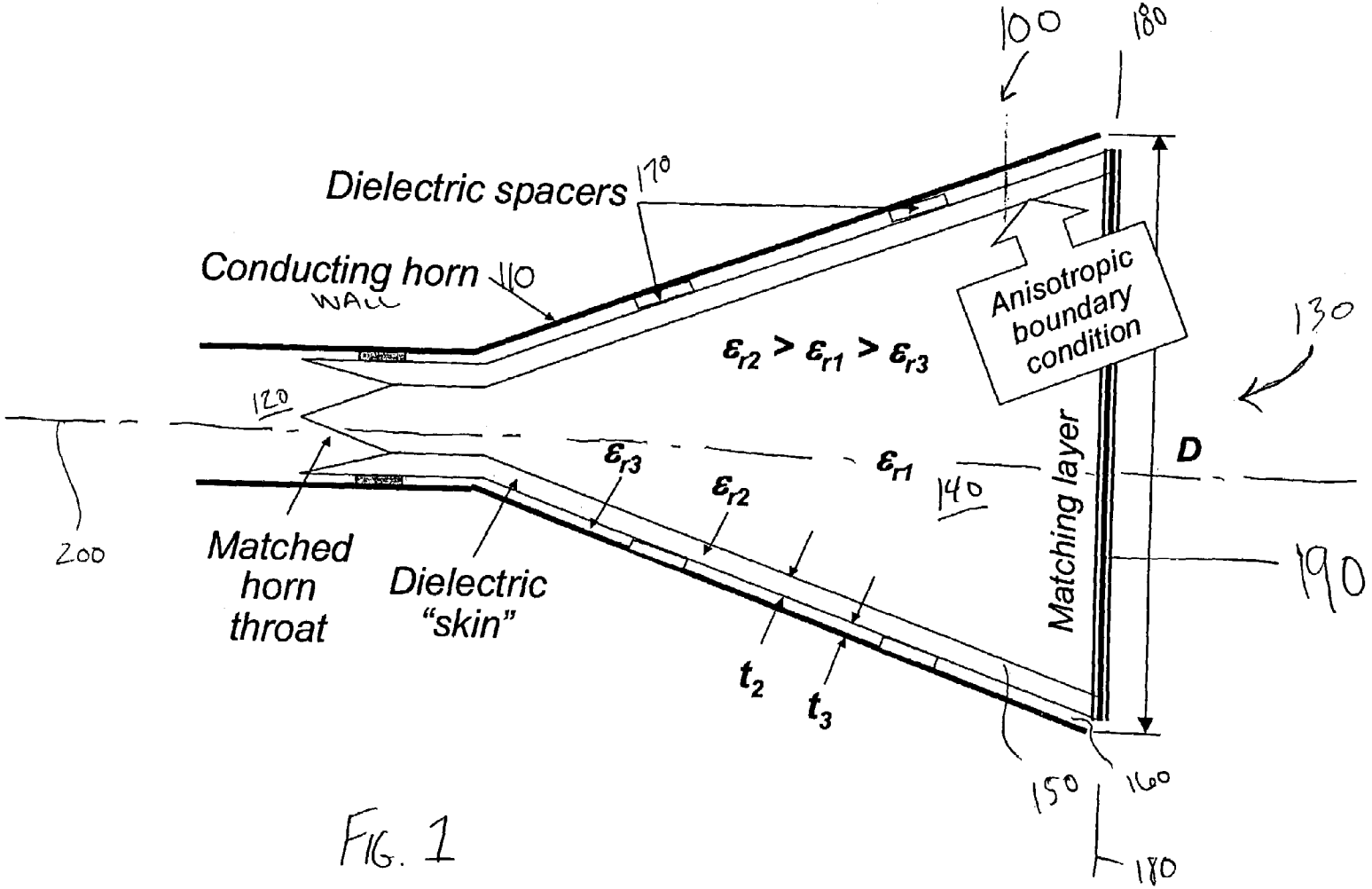
FIG. 1 is a simplified axial view of a hybrid-mode dielectric-loaded horn antenna according to an embodiment of the present invention.

FIG. 1 shows an axial cut of a dielectrically loaded horn 100 according to an embodiment of the present invention taken along an axis 200. Horn 100 includes a conducting horn wall 110 extending from a throat region 120. Horn wall 110 extends from throat 120 to define an aperture 180 having a diameter D. While referred to as "diameter," it will be appreciated by those skilled in the art that horn 100 may have a variety of shapes, and that aperture 180 may be circular, elliptical, rectangular, square, or some other configuration all within the scope of the present invention. Horn 100 has anisotropic wall impedance according to (1) and (2) and can be designed to meet the balanced hybrid condition in (3) in the range from hard to soft boundary conditions.

The space within horn 100 is at least partially filled with a dielectric core 130. In one embodiment, dielectric core 130 comprises an inner core portion 140 and an outer core portion 150. In some embodiments, inner core portion 140 comprises foam, honeycomb, or the like, and outer core portion 150 comprises polystyrene, polyethylene, teflon, or the like. It will be appreciated by those skilled in the art that alternative materials also may be used within the scope of the present invention.

In some embodiments, dielectric core 130 is separated from wall 110 by a gap 160. In one embodiment, gap 160 is filled or at least partially filled with air. In another embodiment, gap 160 comprises a vacuum. In one embodiment, gap 160 corresponds to a first dielectric layer. In the embodiments having gap 160, a spacer or spacers 170 may be used to position dielectric core 130 away from horn wall 110. Spacer(s) 170 may comprise a variety of shapes and sizes. For example, spacer(s) 170 may comprise one or more spaced rings or ring segments, or longitudinal ridges or ridge segments, running circumferentially around horn wall 110. Spacer(s) 170 may further comprise axially aligned ridges or ridge segments. In still other embodiments, spacer(s) 170 include one or more blocks, foam pieces, honeycomb spacers, and the like. In a particular embodiment, spacer(s) 170 comprise a dielectric material with low dielectric constant. In one embodiment, the axial length of the spacers is one-quarter wavelength (¼λ) of the dielectric spacer material.

In another embodiment, spacer(s) 170 completely fill gap 160. In this manner, spacer(s) 170 define a dielectric layer lining some or all of horn wall 110, and may help to correctly position core 130. In this embodiment, spacers 170 define a first dielectric layer, with outer core portion 150 comprising a second dielectric layer and inner core portion 140 comprising a third dielectric layer. In one embodiment, the dielectric constants of outer core portion 150 and inner core portion 140 are different. In a particular embodiment, outer portion 150 of dielectric core 130 has the highest dielectric constant, while the dielectric constant of inner portion 140 of core 130 falls between that of outer portion 150 and the dielectric material associated with gap 160. In a particular embodiment, outer core portion 150 has a higher dielectric constant than does inner core portion 140. In one embodiment, inner core portion 140 has a higher dielectric constant than does gap 160.

Figure 17:
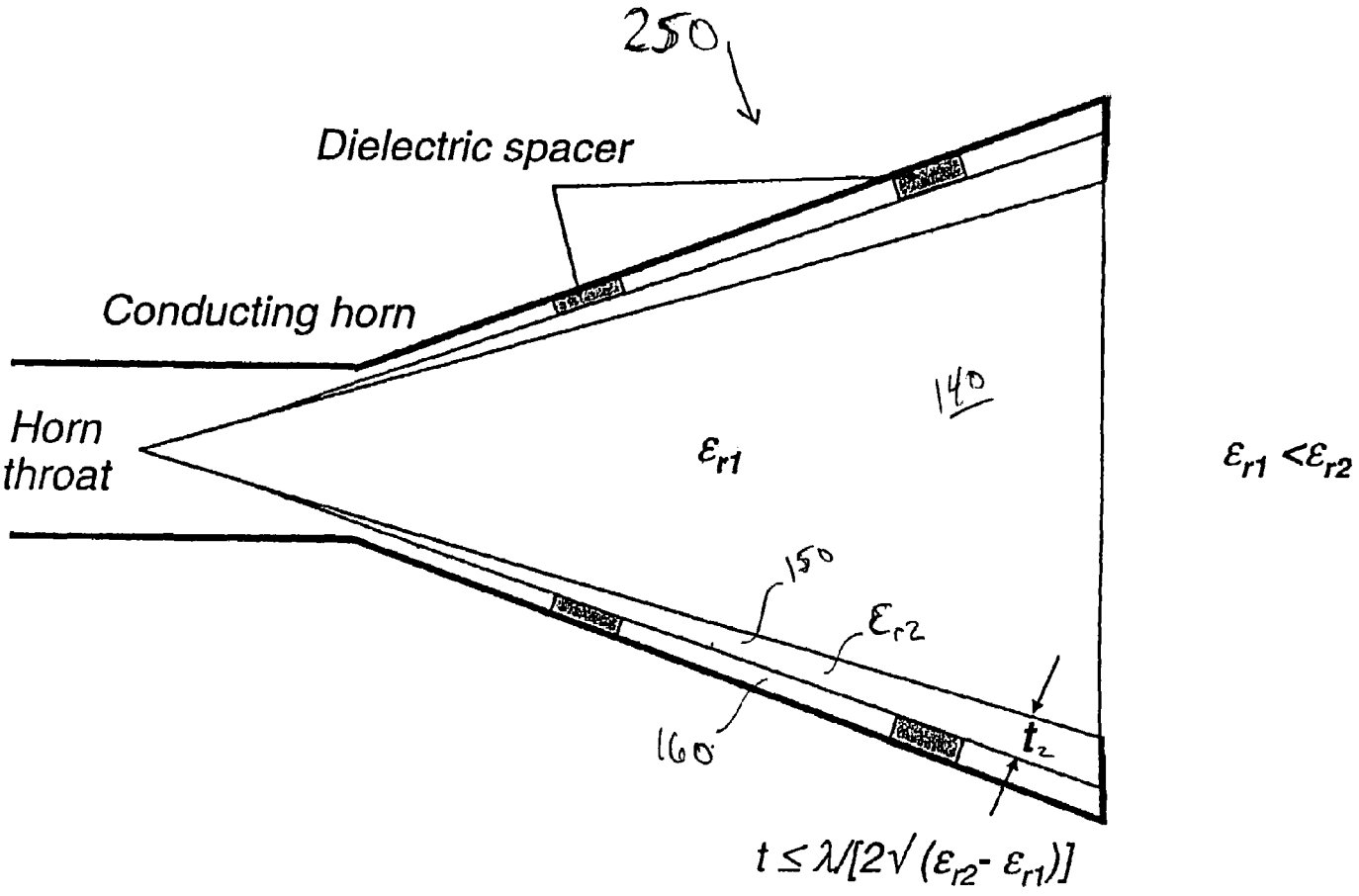

In a particular embodiment, gap 160 is a generally uniform gap having a thickness $t_3$ and extending from about throat region 120 to aperture 180. In one embodiment, outer portion 150 of core 130 has a generally uniform thickness $t_2$. Gap thickness $t_3$ and outer core portion thickness $t_2$ depends on the frequency as shown, for example, in FIG. 4. In some embodiments, such as is shown in FIG. 1, the cross sectional area of inner portion 140 increases with increased distance from throat region 120. In a particular embodiment, thickness $t_3$ and/or thickness $t_2$ vary between the horn throat and aperture. In other words, $t_2$ or $t_3$ vary as a function of the distance along axis 200 from the throat 120 to aperture 180. One or both thicknesses $t_2$, $t_3$ may be greater near throat 120 than near aperture 180, or may be less near throat 120 than near aperture 180. An example of such an embodiment is shown in FIG. 17, in which horn antenna 250 includes outer core portion 150 having variable thickness $t_2$.

In one embodiment, throat region 120 of horn 100 is matched to convert the incident field into a field with approximately the same cross-sectional distribution as is required in aperture 180. This may be accomplished, for example, by the physical arrangement of inner core portion 140 and outer core portion 150 depicted in FIG. 1. In this manner, the desired mode for horn 100 is excited. Further, this arrangement helps to reduce return loss or the reflection of energy in the throat.

Horn 100 may further include one or more matching layers 190 between dielectric and free space in aperture 180. Matching layers 190 may comprise, for example, one or more dielectric materials coupled to core portion(s) 140 and/or 150 near aperture 180. In one embodiment, matching layer 190 has a dielectric constant between the dielectric constant of core portion(s) 140, 150 to which it is coupled, and the dielectric constant of the ambient air or vacuum. In a particular embodiment, matching layer 190 includes a plurality of spaced apart rings or holes. The spaced apart rings or holes (not shown) may have a variety of shapes and may be formed in symmetrical or non-symmetrical patterns. In one embodiment, the holes are formed in the aperture portion of core portions 140 and/or 150 to create a matching layer portion of core 130. In one embodiment, the holes and/or rings are formed to have depth of about one-quarter wavelength (¼λ) of the dielectric material in which they are formed. In a particular embodiment, outer portion 150 includes a corrugated matching layer (not shown) at aperture 180.

Figure 2:
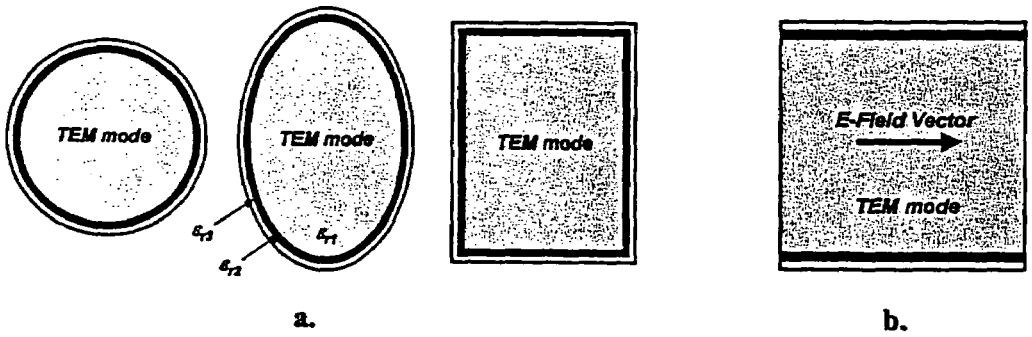
FIGS. 2A and 2B illustrate various horn cross sections for dual linear or circular polarization, and for single linear polarization, respectively.

Horns 100 of the present invention can have different cross sections, including circular, rectangular, elliptical, or the like for circular or linear polarization (FIG. 2A). In one embodiment, a rectangular cross section for linear polarization and maximum gain is used (FIG. 2B). Horn 100 may also be implemented as a profiled horn for reduced size. Since the central region can be designed with low dielectric constant or permittivity, minimal or reduced overall RF loss can be achieved.

Plane Wave Horn Model

Figure 3:
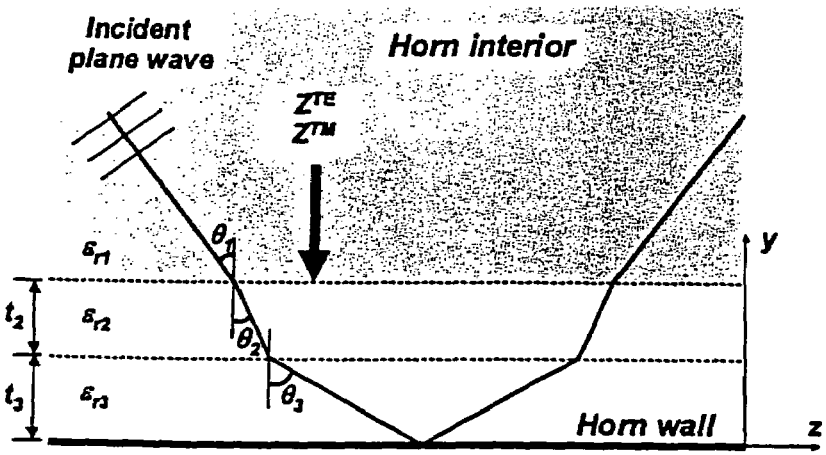
FIG. 3 depicts an electromagnetic boundary model for plane wave incident field according to an embodiment of the present invention.

FIG. 3 shows the model for a plane wave incidence on the boundary. By expressing the electric and magnetic fields in the three regions, and forcing continuous tangential fields and continuous tangential propagation constant across the two boundaries, the following transverse electric (TE) and transverse magnetic (TM) boundary impedances can be derived at $y=t_2+t_3$:

$$Z^{TE} = Z_x = -\frac{E_x}{H_z} = -j\eta_0 \frac{k_0}{k_{y2}} \frac{k_{y3}T_2 + k_{y2}T_3}{k_{y3} - k_{y2}T_2T_3}, \tag{4}$$

$$Z^{TM} = Z_z = \frac{E_z}{H_x} = -j\eta_0 \frac{k_{y2}}{k_0\varepsilon_{r2}} \frac{\varepsilon_{r3}k_{y2}T_2 + \varepsilon_{r2}k_{y3}T_3}{\varepsilon_{r3}k_{y2} - \varepsilon_{r2}k_{y3}T_2T_3}, \tag{5}$$

where $\eta_0$ is the free space wave impedance, $k_0=2\pi/\lambda_0$ is the free space wave number and $\lambda_0$ is the free space wavelength. The orientation of the coordinate system as well as the relative permittivities $\epsilon_{r1}$, $\epsilon_{r2}$ and $\epsilon_{r3}$ are defined in FIG. 3, $T_q=\tan(k_{yq}t_q)$, q=2 or 3, and the wave numbers are:

$$k_{y2} = k_0\sqrt{\varepsilon_{r2} - \varepsilon_{r1}\sin^2\theta_1} \xrightarrow[\theta_1 \to 90^\circ]{} k_0\sqrt{\varepsilon_{r2} - \varepsilon_{r1}} \tag{6}$$

$$k_{y3} = k_0\sqrt{\varepsilon_{r3} - \varepsilon_{r1}\sin^2\theta_1} \xrightarrow[\theta_1 \to 90^\circ]{} k_0\sqrt{\varepsilon_{r3} - \varepsilon_{r1}} \tag{7}$$

where the angle of incidence $\theta_1$ are defined in FIG. 3. Gracing incidence or $\theta_1=90°$ is approximately achieved when the waveguide is operated well above cut-off, which occurs in the aperture of the horn.

By inserting (4) and (5) into (3), the following design condition is obtained for the support of modes under balanced hybrid conditions in the central (interior) horn region:

$$R = \frac{Z^{TE}Z^{TM}}{\eta_1} = -\frac{\varepsilon_{r1}}{\varepsilon_{r2}}\frac{k_{y3}T_2 + k_{y2}T_3}{k_{y3} - k_{y2}T_2T_3}\frac{\varepsilon_{r3}k_{y2}T_2 + \varepsilon_{r2}k_{y3}T_3}{\varepsilon_{r3}k_{y2} - \varepsilon_{r2}k_{y3}T_2T_3} = 1, \tag{8}$$

where $\eta_1$ is the wave impedance in the central horn region. Although there are solutions to (8) for real $T_3$, it can be shown that when hard boundary conditions from (1) are applied to (4) and (5), a solution is obtained only when $T_3$ is imaginary. Consequently, solutions with evanescent fields in the outer region are being sought, such that $$k_{y3}=jk'_{y3}=jk_0\sqrt{\epsilon_{r1}\sin^2\theta_1-\epsilon_{r3}} \quad \text{and} \quad T_3=jTH_3=j\tanh(k'_{y3}t_3).$$

This is achieved for gracing incidence if $\epsilon_{r1}>\epsilon_{r3}$. Thus the following expression for supporting balanced hybrid modes in the central horn region can be derived:

$$t_2 = \frac{\lambda_0}{2\pi\sqrt{\varepsilon_{r2} - \varepsilon_{r1}\sin^2\theta_1}}\frac{-B \pm \sqrt{B^2 - 4AC}}{2A} \tag{9}$$

where $$A = \varepsilon_{r1}\varepsilon_{r3} - \varepsilon_{r2}^2TH_3^2 \tag{10}$$

$$B = \varepsilon_{r3}(\varepsilon_{r1} - \varepsilon_{r2})\left(\frac{k_{y2}}{k'_{y3}} - \frac{\varepsilon_{r2}}{\varepsilon_{r3}}\frac{k'_{y3}}{k_{y2}}\right)TH_3$$

$$C = \varepsilon_{r2}(\varepsilon_{r3} - \varepsilon_{r1}TH_3^2).$$

The thickness $t_3$ of the outer region has its minimum value when the square root expression in the numerator of (9) is zero. The special cases $T_2=0$ and $T_2=\infty$ result in the following design condition when applied to (8):

$$t_3 = \frac{\lambda_0}{4\pi\sqrt{\varepsilon_{r1}\sin^2\theta_1 - \varepsilon_{r3}}}\ln\left(\frac{1 + \sqrt{\varepsilon_{r3}/\varepsilon_{r1}}}{1 - \sqrt{\varepsilon_{r3}/\varepsilon_{r1}}}\right) \quad \text{for } T_2 = 0, \tag{11}$$

$$t_3 = \frac{\lambda_0}{4\pi\sqrt{\varepsilon_{r1}\sin^2\theta_1 - \varepsilon_{r3}}}\ln\left(\frac{1 + \sqrt{\varepsilon_{r1}\varepsilon_{r3}}/\varepsilon_{r2}}{1 - \sqrt{\varepsilon_{r1}\varepsilon_{r3}}/\varepsilon_{r2}}\right) \quad \text{for } T_2 = \infty. \tag{12}$$

If $\epsilon_{r1}=\epsilon_{r2}$ both cases above results in the same solution, and similar or identical to a single dielectric soft horn solution.

The condition for ideally soft and hard boundaries can be derived by applying (4) and (5) to (1) for hard boundary condition, and to equation (2) for soft boundary condition. Both these boundary conditions result in the same expression for $t_3$, but different $t_2$ according to:

$$t_3 = \frac{\lambda_0}{4\pi\sqrt{\varepsilon_{r1}\sin^2\theta_1 - \varepsilon_{r3}}}\ln\left(\frac{1 + \sqrt{\varepsilon_{r3}/\varepsilon_{r2}}}{1 - \sqrt{\varepsilon_{r3}/\varepsilon_{r2}}}\right), \tag{13}$$

soft and hard boundaries,

-continued $$t_2 = \frac{\lambda_0}{2\pi\sqrt{\varepsilon_{r2} - \varepsilon_{r1}\sin^2\theta_1}}\left[\tan^{-1}\sqrt{\frac{\varepsilon_{r3}(\varepsilon_{r2} - \varepsilon_{r1}\sin^2\theta_1)}{\varepsilon_{r2}(\varepsilon_{r1}\sin^2\theta_1 - \varepsilon_{r3})}} + \pi\right], \tag{14}$$

soft boundary, $$t_2 = \frac{\lambda_0}{2\pi\sqrt{\varepsilon_{r2} - \varepsilon_{r1}\sin^2\theta_1}}\tan^{-1}\sqrt{\frac{\varepsilon_{r2}(\varepsilon_{r1}\sin^2\theta_1 - \varepsilon_{r3})}{\varepsilon_{r3}(\varepsilon_{r2} - \varepsilon_{r1}\sin^2\theta_1)}}, \tag{15}$$

hard boundary.

Based on FIG. 3, the following pertinent plane wave electric field components can be derived for regions 2 and 3:

$$E_{x2}^{TE} = \frac{k'_{y3}\sin[k_{y2}(y - t_3)] + k_{y2}\cos[k_{y2}(y - t_3)]\tanh(k'_{y3}t_3)}{k'_{y3}\sin(k_{y2}t_2) + k_{y2}\cos(k_{y2}t_2)\tanh(k'_{y3}t_3)}, \tag{16}$$

$$E_{x3}^{TE} = \frac{\frac{k_{y2}}{k'_{y3}}}{k'_{y3}\sin(k_{y2}t_2) + k_{y2}\cos(k_{y2}t_2)\tanh(k'_{y3}t_3)}\frac{\cosh(k'_{y3}y)}{\cosh(k'_{y3}t_3)}, \tag{17}$$

$$E_{y2}^{TM} = \eta_0\frac{\sqrt{\varepsilon_{r1}}}{\varepsilon_{r2}}\frac{k'_{y3}\cos[k_{y2}(y - t_3)] + k'_{y3}\frac{\varepsilon_{r2}}{\varepsilon_{r3}}\sin[k_{y2}(y - t_3)]\tanh(k'_{y3}t_3)}{k_{y2}\cos(k_{y2}t_2) + k'_{y3}\frac{\varepsilon_{r2}}{\varepsilon_{r3}}\sin(k_{y2}t_2)\tanh(k'_{y3}t_3)}, \tag{18}$$

$$E_{y3}^{TM} = j\frac{\frac{\varepsilon_{r1}}{\varepsilon_{r3}}k_{y2}}{k_{y2}\cos(k_{y2}t_2) + k'_{y3}\frac{\varepsilon_2}{\varepsilon_3}\sin(k_{y2}t_2)\tanh(k'_{y3}t_3)}\frac{\cosh(k'_{y3}y)}{\cosh(k'_{y3}t_3)}. \tag{19}$$

Circular Cylindrical Horn Model

A computer program was developed to predict the propagation constant and field distribution inside a circular cylindrical waveguide symmetrically filled with three dielectric materials as shown in FIG. 1. The method is similar to one used for two dielectric materials. Expressions for the electric and magnetic field components in the three regions were first established. The tangential components of the field as well as the wave numbers were forced to be continuous across the boundaries, resulting in a linear matrix equation including an eight by eight (8×8) matrix. The propagation constant was found by iteratively solving for the determinant of this matrix, while the constants of the field components were found by solving the linear matrix equation through matrix inversion. Finally, the radiation pattern was computed based on the Kirchhoff-Huygen radiation integral.

Computed Results—Plane Wave Model Analysis

Figure 4:
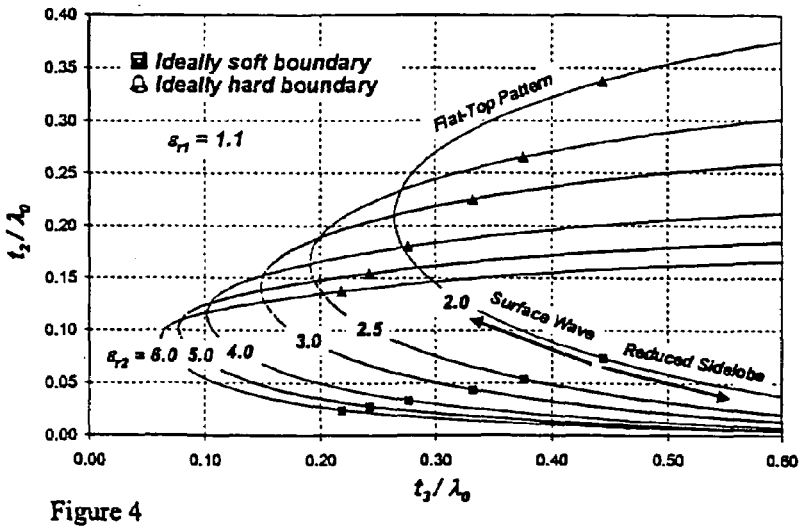
FIG. 4 graphically depicts the relation between $t_2$ and $t_3$ with $\epsilon_{r2}$ as a parameter in the dielectric horn supporting balanced hybrid modes according to an embodiment of the present invention.

In all the cases analyzed below it is assumed that $\epsilon_{r3}=1.0$ (air gap 160 in outer region) and that $\theta_1=90°$ (gracing incidence). In FIG. 4, solutions to the balanced hybrid equation (8) given in (9) and (10) are illustrated for $\epsilon_{r1}=1.1$ and for different values of $\epsilon_{r2}$ between 2.0 and 6.0. It can be seen that there are two solutions to $t_2$ for a given $t_3$ above a certain minimum value. Also, the special solutions to the soft and hard cases in (13) to (15) are marked. The type of waveguide solution corresponding to the different sections of each curve can be studied by the cylindrical waveguide model and will be discussed below.

Figure 5:
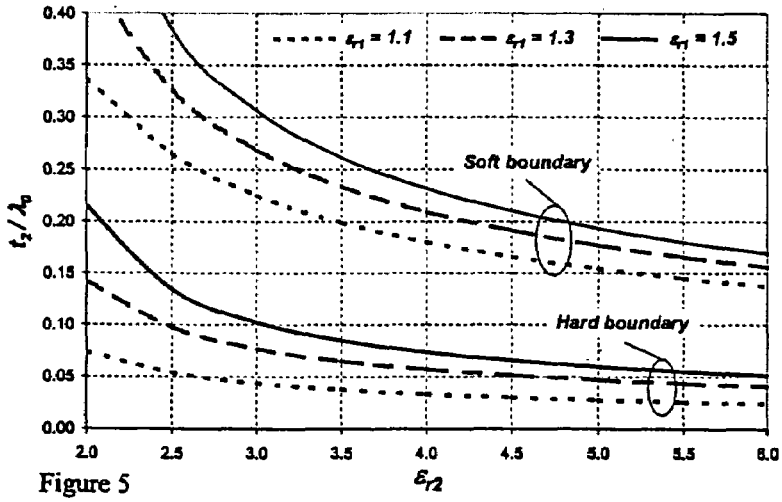
FIG. 5 graphically depicts the relation between $t_2$ and $\epsilon_{r2}$ with $\epsilon_{r1}$ as a parameter in the dielectric horn supporting balanced hybrid modes based on the plane wave model according to an embodiment of the present invention.
Figure 6:
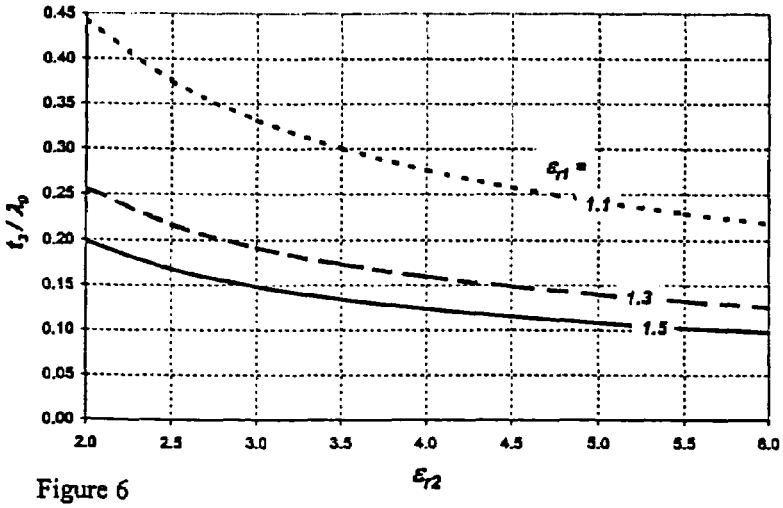
FIG. 6 graphically depicts the relation between $t_3$ and $\epsilon_{r2}$ with $\epsilon_{r1}$ as a parameter in the dielectric horn supporting balanced hybrid modes according to an embodiment of the present invention.

FIG. 5 shows the relation between $t_2$ and $\epsilon_{r2}$ with $\epsilon_{r1}$ as a parameter based on (14) and (15) for soft and hard boundary conditions. It can be seen that $t_2$ decreases with decreasing $\epsilon_{r1}$ and with increasing $\epsilon_{r2}$. FIG. 6 shows the relation between $t_3$ and $\epsilon_{r2}$ with $\epsilon_{r1}$ as a parameter for soft and hard boundaries based on (13). As stated under (13) the curves for hard and soft boundaries are identical. Here $t_3$ decreases with increasing $\epsilon_{r1}$ and with increasing $\epsilon_{r2}$.

Figure 7:
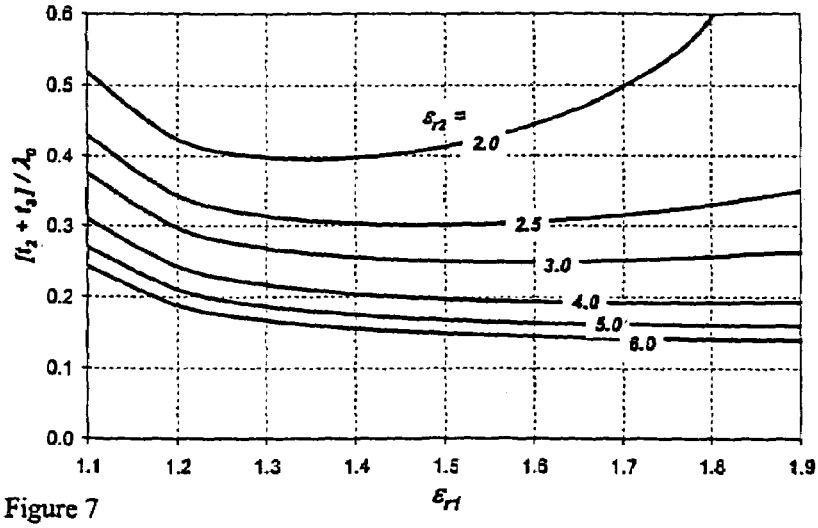
FIG. 7 graphically depicts a total wall thickness versus $\epsilon_{r1}$ with $\epsilon_{r2}$ as a parameter in the dielectric horn under balanced hybrid condition according to an embodiment of the present invention.

The total "wall" thickness $t_2+t_3$ versus $\epsilon_{r1}$ with $\epsilon_{r2}$ as a parameter is illustrated in FIG. 7 for soft and hard boundary conditions. Higher value of $\epsilon_{r2}$ reduces the thickness of the wall, which is expected to result in higher aperture efficiency at the design frequency. Also, there is a minimum wall thickness for a given $\epsilon_{r2}$ vs. $\epsilon_{r2}$, occurring at increasing $\epsilon_{r1}$ when $\epsilon^{r2}$ increases. In comparison, the wall thickness of a single dielectric hard horn with dielectric constant of $\epsilon_r$ is $t=\frac{1}{4}\sqrt{\epsilon_r-1}$), which is slightly less than $t_2+t_3$ of the horn above for a given $\epsilon_{r2}=\epsilon_r$.

Figure 8:
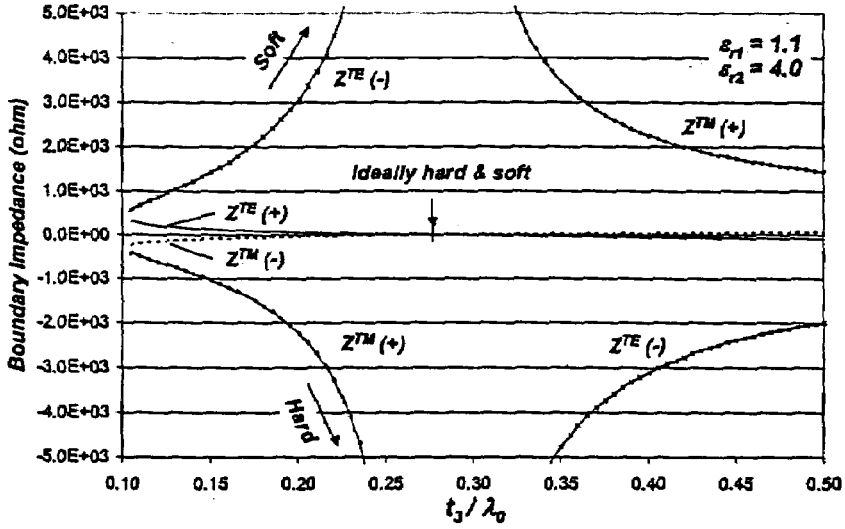
FIG. 8 graphically depicts a boundary impedance versus $t_3$ with $\epsilon_{r1}$=1.1 and $\epsilon_{r2}$=4.0 under balanced hybrid condition in a dielectric horn according to an embodiment of the present invention.

FIG. 8 illustrates the boundary impedances versus $t_3$ on the inner boundary for $\epsilon_{r1}=1.1$ and $\epsilon_{r2}=4.0$ under balanced hybrid condition. For hard and soft boundary conditions the impedance is either zero or infinite as discussed above. It can be seen that the boundary impedance can be designed for any positive or negative value between 0 and infinity for a given combination of $t_2$ and $t_3$, where each point along the curve meets the balanced hybrid condition. In FIG. 8, the symbols "+' and "−" refer to the upper and lower part of the curve, respectively, in FIG. 4 with $\epsilon_{r2}=4.0$.

Figure 9:
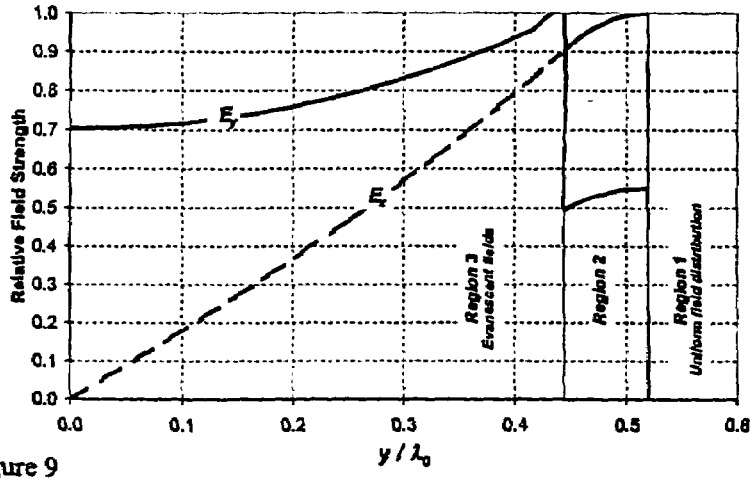
FIG. 9 graphically depicts a field distribution in the wall region of a dielectric horn with $\epsilon_{r2}$=2.0 and $\epsilon_{r1}$=1.1, based on FIG. 3.

FIG. 9 shows the computed linear field distribution in regions 2 and 3 for both polarizations transverse to the direction of propagation (z) where the field strength in the central region 1 is unity. The distributions are computed based on the field expressions in (16) to (19). Although the fields are evanescent in region 3, the component normal to the boundary is still only 70% of the field strength in the central region, while the component parallel to the boundary drops to zero at the outer wall. In region 2, the normal component is discontinuous and lower than in the two surrounding regions. High field strength in the wall region is advantageous for aperture efficiency, but degrades radiated cross-polarization since the field is not balanced.

Figure 10:
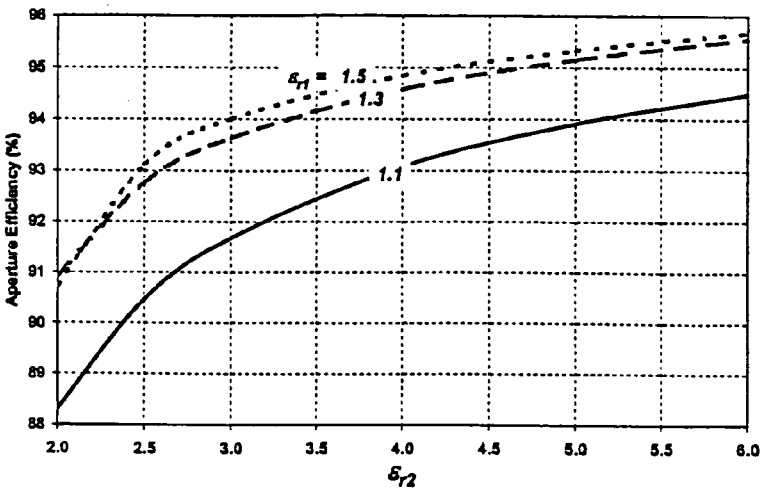
FIG. 10 graphically depicts an overall aperture efficiency versus $\epsilon_{r2}$ for a dielectric horn with 3.38λ overall aperture diameter according to an embodiment of the present invention.

FIG. 10 shows aperture efficiency versus $\epsilon_{r2}$ for a dielectric horn with $\epsilon_{r2}$ as a parameter. It is assumed that the linear field distribution in FIG. 9 is applied to a waveguide with circular symmetry and 3.38λ overall diameter. The overall aperture efficiency is computed from power integration over the aperture fields given in (16) to (19). As indicated earlier, the efficiency increases with increasing $\epsilon_{r2}$. Also, when $\epsilon_{r1}$ increases the efficiency increases until it saturates around $\epsilon_{r1}=1.3-1.5$, depending on the value of $\epsilon_{r2}$. Since in one embodiment a low dielectric constant is desired in the central region, $\epsilon_{r2}\approx1.3$ in a particular embodiment where high aperture efficiency is desired. Increasing $\epsilon_{r2}$ increases the efficiency, but is expected to decrease the bandwidth. For larger apertures the aperture efficiency will increase.

Computed Results—Circular Cylindrical Model Analysis

Figure 11:
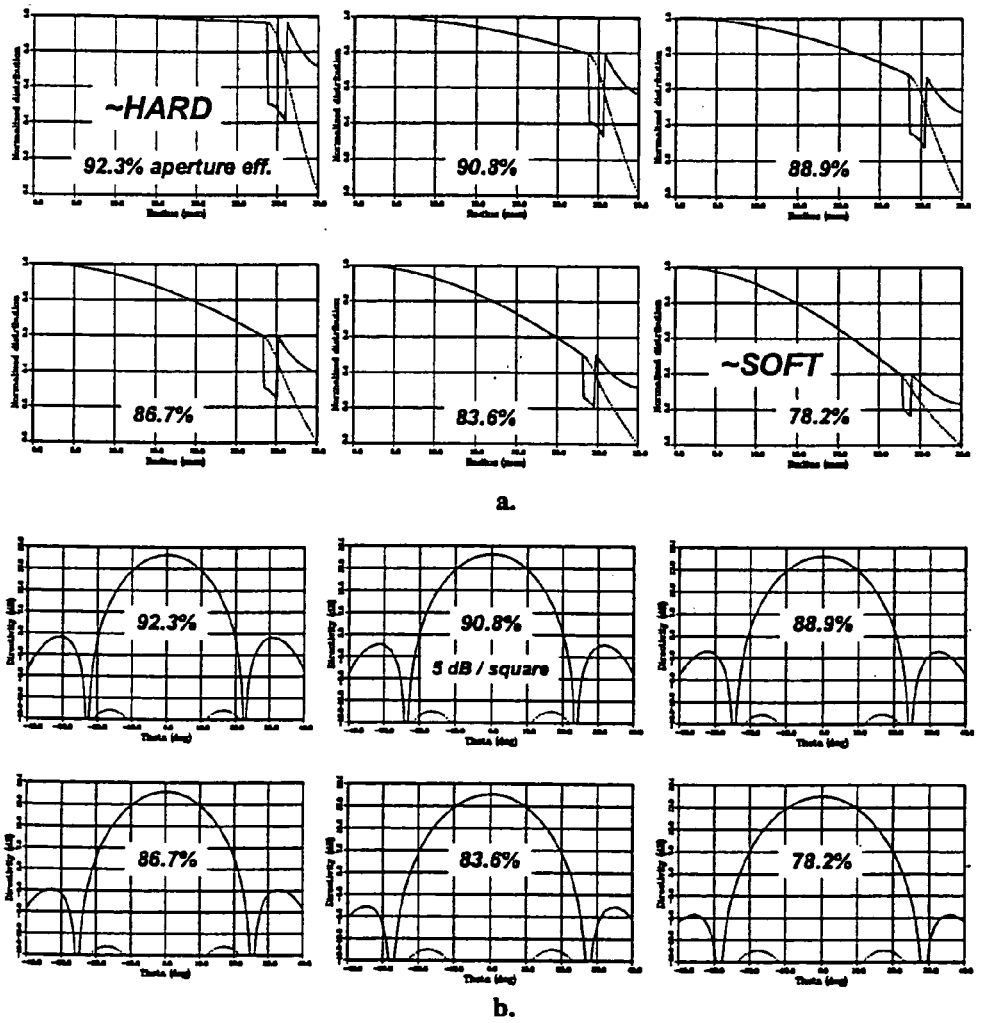
FIG. 11A graphically depicts aperture distributions for a dielectric horn with 70 mm overall aperture diameter at 14.5 GHz, $\epsilon_{r1}$=1.3 and $\epsilon_{r2}$=2.5 based on the circular cylindrical model according to an embodiment of the present invention.
FIG. 11B graphically depicts co- and cross-polarization radiation patterns for a dielectric horn with 70 mm overall aperture diameter at 14.5 GHz, $\epsilon_{r1}$=1.3 and $\epsilon_{r2}$=2.5 based on the circular cylindrical model according to an embodiment of the present invention.
Figure 12:
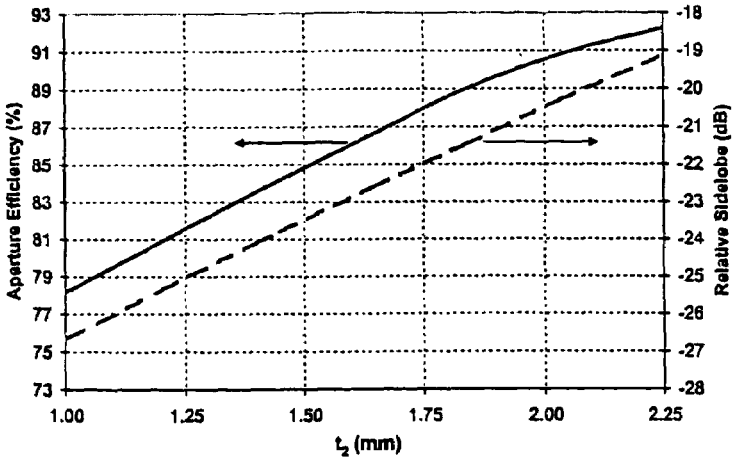
FIG. 12 graphically depicts computed aperture efficiency and relative peak sidelobe level versus $t_2$ under balanced hybrid condition for the horn in FIG. 11 at 14.5 GHz.

In this section, the results are based on computations based on the circular cylindrical model. In all embodiments, the horn diameter is 70 mm or 3.38λ at 14.5 GHz, $\epsilon_{r1}=1.3$, and uniform phase is assumed over the aperture (ideal cylindrical aperture model). FIG. 11A shows aperture distributions for six different designs between ideally hard and approximately soft for a horn at 14.5 GHz and $\epsilon_{r2}\approx2.5$, while FIG. 11B shows the corresponding radiation patterns. The hard boundary aperture efficiency of 92.3% is only 0.5% lower than the efficiency computed by the plane wave model in FIG. 10. FIG. 12 presents curves for aperture efficiency and relative peak sidelobe level versus $t_2$ for the same case. These curves can be used to trade horn efficiency against sidelobe level. A similar set of trade curves can be generated for horn efficiency or sidelobe level versus beamwidth. The examples shown in FIGS. 11 and 12 can be found along the section of the curve with $\epsilon_{r2}=2.5$ in FIG. 4 on the right side of the hard boundary mark.

Figure 13:
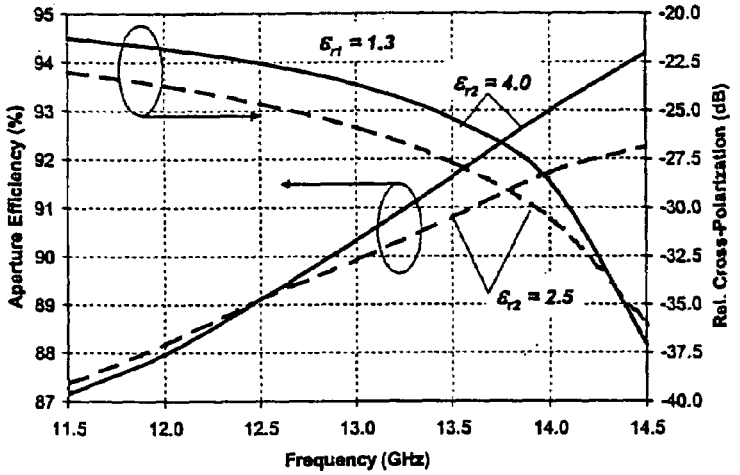
FIG. 13 graphically depicts computed aperture efficiency and relative peak cross-polarization versus frequency for a horn with 70 mm overall aperture diameter, $\epsilon_{r1}$=1.3 and with $\epsilon_{r2}$=2.5 and 4.0 based on the circular cylindrical model, designed for hard boundary conditions at 14.5 GHz, according to an embodiment of the present invention.
Figure 14:
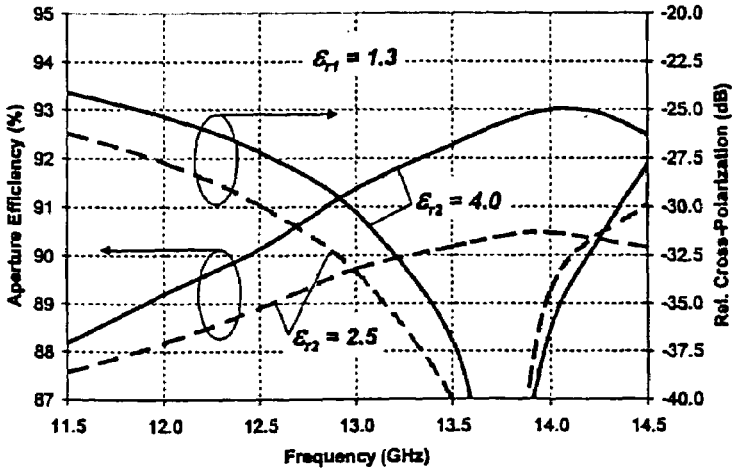
FIG. 14 graphically depicts computed aperture efficiency and relative peak cross-polarization versus frequency for a horn with 70 mm overall aperture diameter, $\epsilon_{r1}$=1.3 and with $\epsilon_{r2=}$2.5 and 4.0 based on the circular cylindrical model, designed for balanced hybrid conditions at 13.5 GHz, according to an embodiment of the present invention.

FIG. 13 shows aperture efficiency and relative peak cross-polarization versus the frequency with $\epsilon_{r2}=2.5$ and 4.0. In one embodiment, the horn is designed with hard boundary condition at 14.5 GHz. Beyond this frequency the waveguide supports surface waves, indicated on the curve in FIG. 4 to the left of the hard boundary mark. FIG. 14 presents corresponding results for a horn with the same dielectric materials, designed for balanced hybrid condition at 13.5 GHz. It shows that the embodiment where $\epsilon_{r2}=2.5$ yields larger bandwidth compared to the embodiment where $\epsilon_{r2}=4.0$. Slightly above the center frequency cross-polarization contributions from the core region and the wall region add up destructively to generate relative peak cross-polarization below −40 dB. The design results in a worst-case cross-polarization below −26.5 dB and aperture efficiency higher than 87.5 dB over the frequency band 11.7 to 14.5 GHz, while cross-polarization under −30 dB and aperture efficiency over about 89% has been achieved over about a 15% bandwidth.

Figure 15:
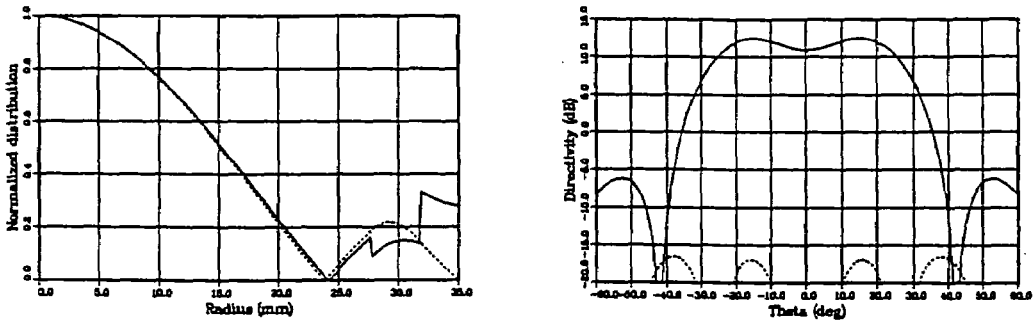
FIG. 15A graphically depicts computed aperture efficiency for a dielectric horn design with flat top pattern based on the circular cylindrical model with 70 mm aperture diameter at 14.5 GHz ($\epsilon_{r1}$=1.3, $\epsilon_{r2}$=2.5, $t_2$=4.0 mm, $t_3$=3.3 mm) according to an embodiment of the present invention.
FIG. 15B graphically depicts computed radiation pattern for a dielectric horn design with flat top pattern based on the circular cylindrical model with 70 mm aperture diameter at 14.5 GHz ($\epsilon_{r1}$=1.3, $\epsilon_{r2}$=2.5, $t_2$=4.0 mm, $t_3$=3.3 mm) according to an embodiment of the present invention.

FIG. 15 shows aperture distribution and radiation pattern for a dielectric-loaded horn designed to generate a broad pattern. In this embodiment the fields in the wall region (regions 2 and 3 in FIG. 3) have been utilized constructively to produce a $J_1(x)/x$-type distribution which radiates an approximately flat top pattern. Such feed horns can be used as reflector feeds for optimal antenna efficiency. They can alternatively be implemented as dual hybrid-mode corrugated horns or hybrid-mode horns with a dielectric phase-correcting lens in the aperture. Solutions to flat top patterns can be found along the section of the curve in FIG. 4 to the left of the soft boundary mark.

Figure 16:
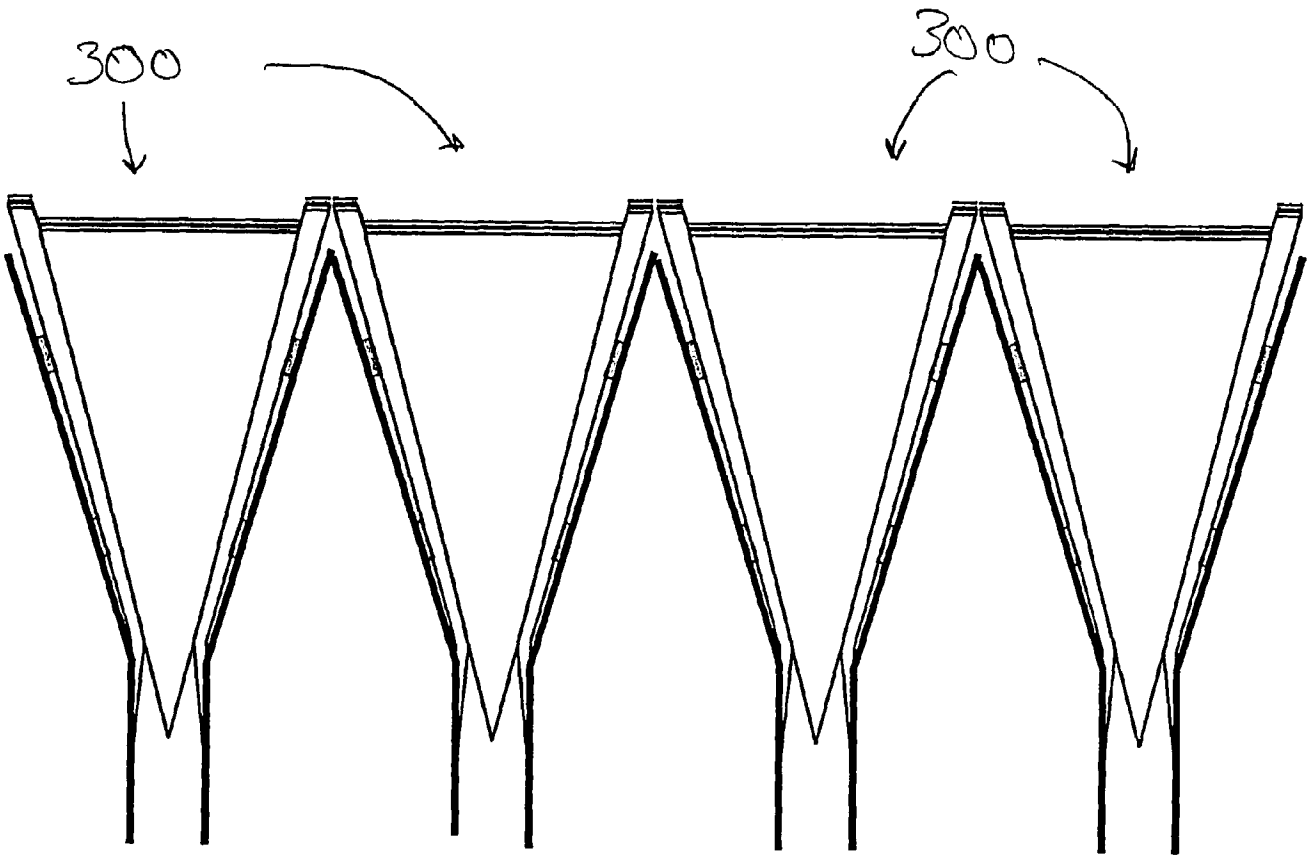
FIGS. 16–18 are simplified schematics depicting various horn antenna embodiments according to the present invention.

FIG. 16 depicts an alternative horn antenna embodiment according to the present invention. More specifically, FIG. 16 depicts an array of horn antennas 300 according to the present invention. Horn antennas 300 may comprise one or more different horn antenna embodiments disclosed or discussed herein, including without limitation horn antenna 100 depicted in FIG. 1, and horn antenna 250 depicted in FIG. 17.

Figure 18:
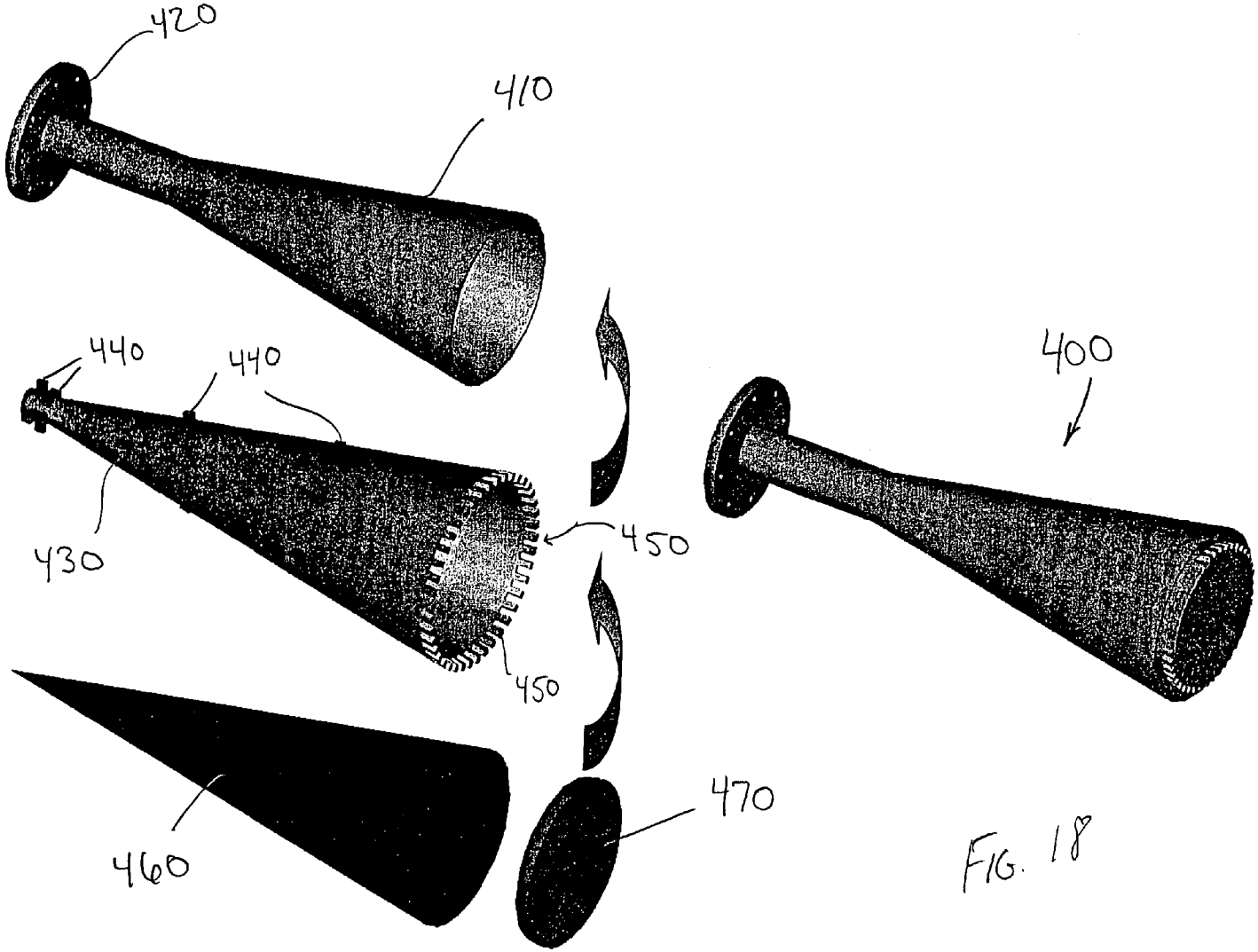

FIG. 18 depicts a simplified overall view of a horn antenna 400 according to an embodiment of the present invention. Horn 400 components and their materials may be similar or identical to those discussed in conjunction with earlier figures, including FIG. 1. As shown in FIG. 18, horn antenna 400 includes a horn wall 410 coupled to a flange 420. Flange 420 may be used, for example, to couple horn antenna 400 to a desired structure, spacecraft, or the like. Horn 400 further includes an inner core portion 460, which is disposed within an outer core portion 430. Outer core portion 430 may further include, or be coupled to a plurality of spacers 440. Spacers 440 are disposed between the inner surface of horn wall 410 and the outer surface of outer core portion 430, to help provide the proper alignment and positioning of the two relative to one another. As shown in FIG. 18, a matching layer 470 is coupled to inner core portion 460. Outer core portion 430, in one embodiment, includes a corrugated edge 450 to operate as a matching layer for outer core portion 430.

Figure 19:
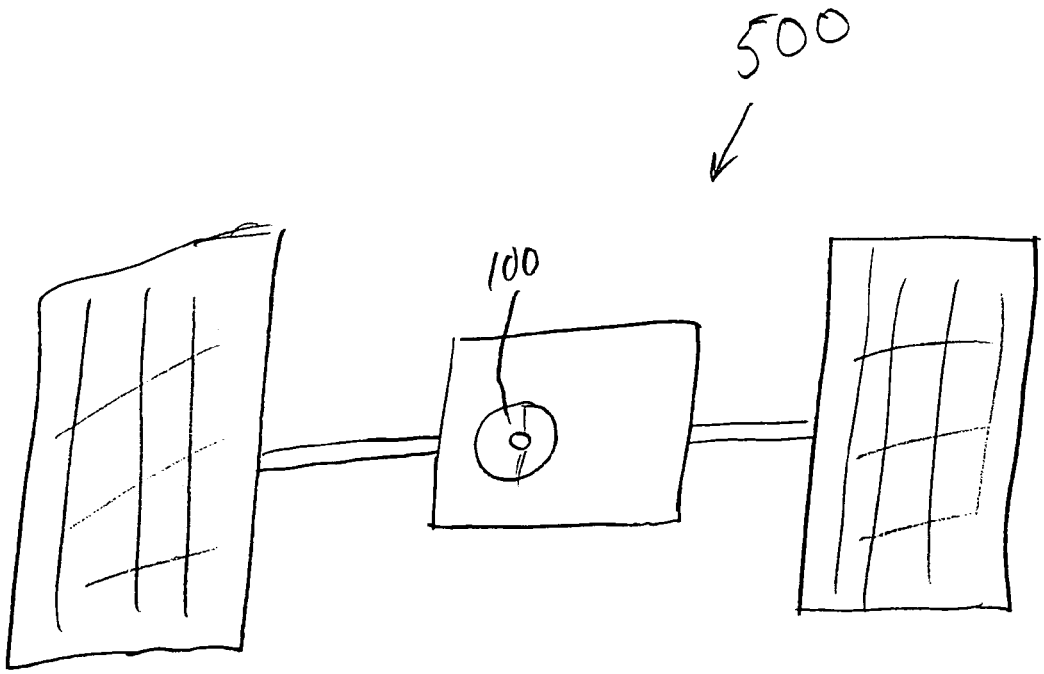
FIG. 19 is a simplified schematic of a spacecraft according to the present invention.

FIG. 19 depicts a simplified schematic of a spacecraft 500 having one or more horn antennas 100 according to the present invention. Again, horn antenna 100 associated with spacecraft 500 may include one or more embodiments of horn antennas discussed herein.

The present invention provides a new class of hybrid mode horn antennas which can be designed for a specific gain or sidelobe requirement and low cross-polarization. In one embodiment, the horn consists of a conical metal horn with a dual dielectric core, separated from the horn wall by a thin air-gap and/or low-dielectric material. In one embodiment, the central conical core is implemented with low dielectric, ensuring low dielectric loss, or with solid, low loss dielectric to allow for millimeter wave implementation.

Cross-polarization is expected to be low since the horn supports modes under balanced hybrid condition inside the central core, although contribution to cross-polarization from the wall region may degrade the cross-polarization performance somewhat. A plane wave model was developed to derive design expressions and generate parametric design curves for the horn. Also, a circular cylindrical waveguide model was developed to analyze the radiation performance of the horn.

In one embodiment, predicted aperture efficiency over about 94% and relative peak cross-polarization under −37 dB was predicted at center frequency for a 3.38λ hard horn with a dielectric constant of 4.0. Cross-polarization under −40 dB has been predicted slightly off center frequency. Similarly, predicted aperture efficiency over about 89% and relative peak cross-polarization under −30 dB was predicted over the frequency band 12.5 to 14.5 GHz for the same aperture size. In one embodiment, the same horn is designed with aperture efficiency ranging from about 92% to about 78% and corresponding relative peak sidelobes between −19 to −26.5 dB at the design frequency, and with cross-polarization under −36 dB over the range. In one embodiment, the horn is used to generate a flat top pattern over a ±30° field-of-view and with −30 dB relative peak cross-polarization.

In one embodiment, the new horn is mechanically simple relative to other known hard horn antennas. According to the present invention, the horn can be used as an element in a limited scan array where a larger aperture size is needed. It can also be used in applications where gain and sidelobes could be traded for optimal antenna performance, e.g. as feeds for reflector antennas or in quasi-optical amplifier arrays. The horns of the present invention are particularly useful in millimeter wave applications in an embodiment. Finally, the flat top pattern design makes it a candidate earth coverage horn on-board satellites and a candidate feed for reflector antennas with enhanced directivity.

Notwithstanding the above description, it should be recognized that many other functions, methods, and combinations thereof are possible in accordance with the invention. Thus, although the invention is described with reference to specific ents and figures thereof, the embodiments and figures are merely illustrative, and ting of the invention. Rather, the scope of the invention is to be determined solely by the appended claims.

The invention claimed is:

1. A horn antenna, comprising:

a conducting horn;

a first dielectric layer lining substantially the entire inner wall of said conducting horn;

a second dielectric layer disposed over at least a portion of the first dielectric layer; and a third dielectric layer disposed over at least a portion of the second dielectric layer;

wherein the second dielectric layer comprises a higher dielectric constant than the third dielectric layer, and the third dielectric layer comprises a higher dielectric constant than the first dielectric layer.

2. The horn antenna as in claim 1 wherein the first dielectric layer comprises an air-filled gap.

3. The horn antenna as in claim 1 wherein the first and second dielectric layers have a generally uniform thickness in an axial direction of the conducting horn.

4. The horn antenna as in claim 1 wherein the first dielectric layer has a variable thickness in an axial direction of the conducting horn.

5. The horn antenna as in claim 1 wherein the second dielectric layer has a variable thickness in an axial direction of the conducting horn.

6. The horn antenna as in claim 1 wherein the conducting horn comprises an inner wall surface, and wherein the second dielectric layer is spaced apart from the inner wall surface by a plurality of spacers.

7. The horn antenna as in claim 6 wherein at least one of the spacers is aligned axially relative to the conducting horn.

8. The horn antenna as in claim 6 wherein at least one of the spacers is aligned circumferentially relative to the conducting horn.

9. The horn antenna as in claim 1 wherein the second dielectric layer further comprises an impedance matching layer near an aperture of the conducting horn.

10. The horn antenna as in claim 9 wherein the impedance matching layer comprises a corrugated impedance matching layer.

11. The horn antenna as in claim 1 wherein the third dielectric layer further comprises an impedance matching layer near an aperture of the conducting horn.

12. The horn antenna as in claim 11 wherein the impedance matching layer comprises a plurality of spaced holes.

13. The horn antenna as in claim 1 further comprising an impedance matched horn throat defined by at least a portion of the second and third dielectric layers.

14. A horn antenna, comprising:

a conducting horn; and a dielectric core coupled to the conducting horn by a plurality of spacers to define a gap between the horn and core;

wherein the dielectric core comprises an outer portion lining substantially the entire inner wall of said conducting horn, and an inner portion, the outer and inner portions each comprising a dielectric material, with the outer portion dielectric material having a greater dielectric constant than the dielectric constant of the inner portion dielectric material.

15. The horn antenna as in claim 14 wherein the gap is at least partially filled with a gas.

16. The horn antenna as in claim 14 wherein the gap comprises a vacuum region.

17. The horn antenna as in claim 14 wherein the gap is at least partially filled with a third dielectric material having a lower dielectric constant than the dielectric constants of both the inner and outer portion dielectric materials.

18. The horn antenna as in claim 17 wherein the spacers comprise the third dielectric material.

19. The horn antenna as in claim 14 wherein the gap is substantially filled with a third dielectric material having a lower dielectric constant than the dielectric constants of both the inner and outer portion dielectric materials.

20. A reflector antenna comprising:

a reflective dish; and at least one horn antenna, the horn antenna comprising:

a conducting horn; and a dielectric core coupled to the conducting horn by a plurality of spacers to define a gap between the horn and core;

the dielectric core comprising an outer portion lining substantially the entire inner wall of said conducting horn, and an inner portion having different dielectric constants, with the outer portion dielectric constant being greater than the inner portion dielectric constant; and wherein the at least one horn antenna is adapted to direct a signal towards the reflective dish.

21. The reflector antenna as in claim 20 wherein the gap comprises a third dielectric material having a lower dielectric constant than the dielectric core inner and outer portions.

22. An antenna array system, comprising:

at least two horn antennas, each horn antenna comprising;

a conducting horn; and a dielectric core coupled to the conducting horn by a plurality of spacers to define a gap between the horn and core;

wherein the dielectric core comprises an outer portion lining substantially the entire inner wall of said conducting horn, and an inner portion, the outer and inner portions each comprising a dielectric material, with the outer portion dielectric material having a greater dielectric constant than the dielectric constant of the inner portion dielectric material.

23. A spacecraft, comprising:

a spacecraft bus; and a horn antenna coupled to the bus, the antenna comprising;

a conducting horn; and a dielectric core coupled to the conducting horn by a plurality of spacers to define a gap between the horn and core;

the dielectric core comprising an outer portion lining substantially the entire inner wall of said conducting horn, and an inner portion having different dielectric constants, with the outer portion dielectric constant being greater than the inner portion dielectric constant.

24. A spacecraft, comprising:

a spacecraft bus; and a horn antenna coupled to the bus, the antenna comprising;

a conducting horn;

a first dielectric layer lining substantially the entire inner wall of said conducting horn;

a second dielectric layer disposed over at least a portion of the first dielectric layer; and a third dielectric layer disposed over at least a portion of the second dielectric layer;

wherein the second dielectric layer comprises a higher dielectric constant than the third dielectric layer, and the third dielectric layer comprises a higher dielectric constant than the first dielectric layer.

* * * * *